US005082290A

United States Patent [19]

Tucker et al.

[11] Patent Number: 5,082,290

[45] Date of Patent: Jan. 21, 1992

[54] LACROSSE STICK

[75] Inventors: Richard B. Tucker, Baltimore; Jackie L. Davis, Aberdeen; Fielding H. Lewis, Jr., Queenstown, all of Md.

[73] Assignee: STX, Inc., Baltimore, Md.

[21] Appl. No.: 647,058

[22] Filed: Jan. 29, 1991

Related U.S. Application Data

[63] Continuation-in-part of Ser. No. 550,562, Jul. 10, 1990, Pat. No. 5,007,652, which is a continuation-in-part of Ser. No. 414,258, Sep. 29, 1989, Pat. No. 4,940,243.

[51] Int. Cl.[5] ..... A63B 59/02

[52] U.S. Cl. ..... 273/326

[58] Field of Search ..... 273/326, 70, 73 D

[56] References Cited

U.S. PATENT DOCUMENTS

| | | | |
|---|---|---|---|
| 1,179,435 | 4/1916 | Hutchinson | 273/73 D |
| 1,240,336 | 9/1917 | Goodell | 273/70 |
| 1,260,173 | 3/1918 | Finney | 273/70 |
| 3,507,495 | 4/1970 | Tucker et al. | 273/326 |
| 3,822,062 | 7/1974 | Tucker et al. | 273/326 |
| 3,905,088 | 9/1975 | Tucker et al. | 273/326 |
| 3,966,207 | 6/1976 | Pass | 273/73 D |
| 4,034,984 | 7/1977 | Crawford et al. | 273/326 |
| 4,037,841 | 7/1977 | Lewis, Jr. | 273/326 |
| 4,097,046 | 6/1978 | Friant | 273/326 |
| 4,138,111 | 2/1979 | Rule | 273/326 |
| 4,206,918 | 6/1979 | Lewis, Jr. | 273/326 |
| 4,739,994 | 4/1988 | Lewis, Jr. | 273/326 |
| 4,861,042 | 8/1989 | Trettin | 273/326 |
| 4,940,243 | 7/1990 | Tucker et al. | 273/326 |
| 5,007,652 | 4/1991 | Tucker et al. | 273/326 |

*Primary Examiner*—William H. Grieb

*Attorney, Agent, or Firm*—Breiner & Breiner

[57] ABSTRACT

A double-wall synthetic lacrosse stick comprising a generally V-shaped frame adapted to receive a web includes two side walls joined at a juncture and diverging therefrom. A transverse wall joining the ends of the side walls opposite of the juncture and a stop for receiving a lacrosse ball in the head is described. The stop comprises a base and at least one leg integral with and extending from the base removably fitted into an opening in the juncture, with the base fitting substantially flush with the juncture. The invention permits the ready insertion and removal of the stop from the lacrosse head.

3 Claims, 2 Drawing Sheets

LACROSSE STICK

RELATED APPLICATION

This application is a continuation-in-part of application U.S. Ser. No. 550,562 filed July 10, 1990, now U.S. Pat. No. 5,007,652; which, in turn, is a continuation-in-part of application U.S. Ser. No. 414,258 filed Sept. 29, 1989, now U.S. Pat. No. 4,940,243.

FIELD OF INVENTION

This invention relates to lacrosse sticks, and more particularly to new and novel stop means for a lacrosse stick head which provides advantages over the prior art stop means.

BACKGROUND OF THE INVENTION

In the early prior art, lacrosse sticks were customarily made of wood, usually hickory, shaped by American Indians with whom the game originated. Such lacrosse sticks lacked uniformity as to quality, strength, weight, and feel in the hands of a player.

To overcome the disadvantages of the prior art, great strides have been made in the recent past in the construction of lacrosse stick heads and handles. For example, U.S. Pat. Nos. 3,507,495; 3,822,062, and 3,905,088 to Tucker et al; and U.S. Pat. No. 4,034,984 to Crawford et al disclose elastomeric lacrosse stick heads and parts therefor which are highly resilient and have dramatically revolutionized the sport of lacrosse. Additionally, U.S. Pat. Nos. 4,739,994; 4,037,841, and 4,206,918 to Lewis disclose novel lacrosse stick handles which haVe further enhanced the quality of lacrosse sticks. Accordingly, it is now common for lacrosse stick heads and handles to be interchangeable in order to suit the needs of a player, or for repair of a broken head or handle.

The prior art, for example in the above-noted U.S. Pat. Nos. 3,507,495 and 3,822,062, teaches the attachment of stop means at the juncture of the side walls of the lacrosse stick head for receiving and cushioning a lacrosse ball. As apparent from the above patents, for example FIG. 8 of the '495 patent and FIGS. 4 of the '062 patent, the stop is of a material such as foam rubber secured by an adhesive or the like to the juncture and side walls. These patents provide an adequate stop means. However, at times the stop means loosens and requires repair. The present invention provides an improved stop means.

PRIMARY OBJECTS AND GENERAL DESCRIPTION OF INVENTION

It is a primary object of the present invention to provide a new and novel stop means and including means for attaching a stop means to a lacrosse stick head which can be done rapidly with enhanced security.

Other objects and advantages of the present invention will become apparent from the following general and detailed description of the invention taken in conjunction with the drawing.

Briefly, the objects of the present invention are accomplished in a first preferred embodiment of the invention by providing a lacrosse stick having a head with a generally V-shaped frame adapted to receive a web and stop means. The transverse stop means extends between the side walls of the head and cooperates with a throat portion to facilitate connection of the head to the handle. The throat portion includes an opening for receiving a snap-in stop means. The stop means is comprised of a base having at least one longitudinally extending leg, such as a prong, adapted to extend through the throat portion and, in a preferred embodiment, engages with a slot in the handle, thereby attaching the head to the handle. A second embodiment of the invention is where leg means, such as at least one prong, extend through the throat portion so as to secure the stop means, but not necessarily attaching the handle to the head.

DRAWING AND DETAILED DESCRIPTION

Figure 1:
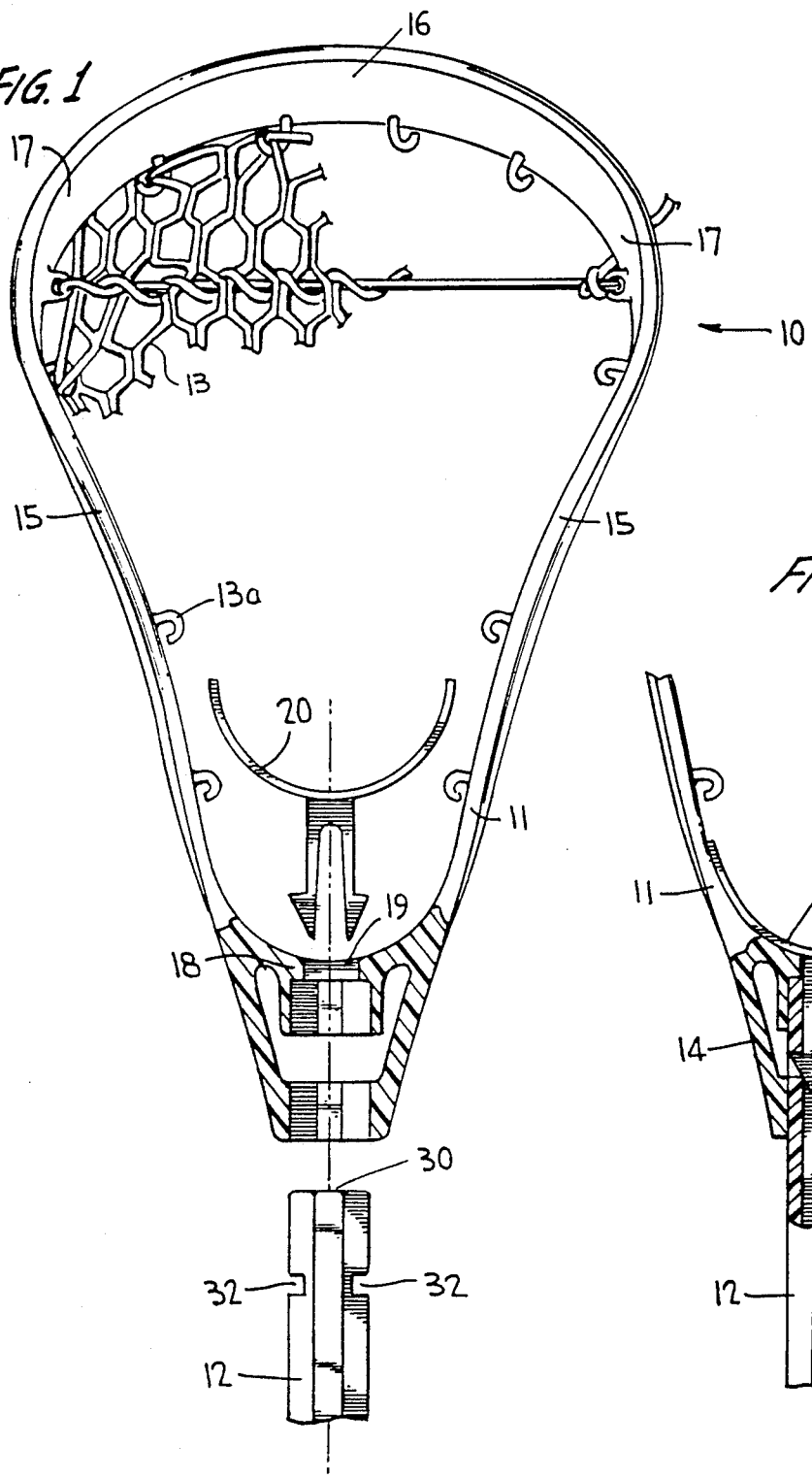
FIG. 1 is a first embodiment illustrating a front exploded elevational view of a lacrosse stick head, partly in section; the snap-in stop means, the handle, and the tab arrangement and construction.
Figure 2:
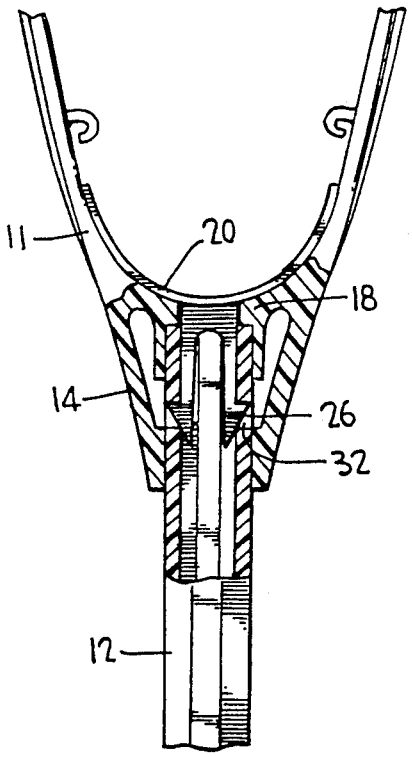
FIG. 2 is a front view of the embodiment of FIG. 1, partly in section, showing the components locked together.
Figure 3:
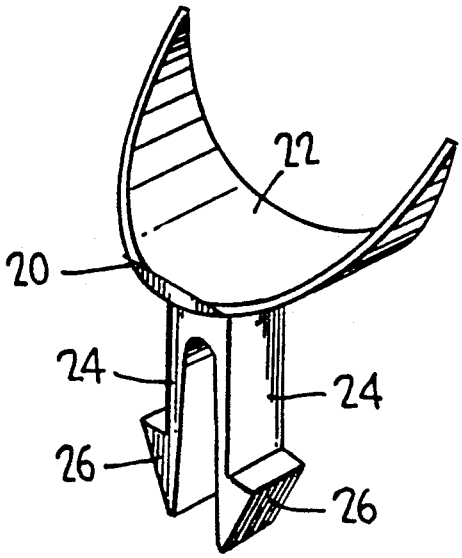
FIG. 3 is a perspective view of one embodiment of the snap-in stop means of the invention.

The illustrated embodiment of the invention is a lacrosse stick generally designated 10 which includes a head generally designated 11 and a handle generally designated 12. The head is provided with webbing or netting partially shown in FIG. 1 and generally indicated at 13.

The head 11 is constructed similarly to a head disclosed in Tucker et al, U.S. Pat. No. 3,507,495; and shown also in later Tucker et al, U.S. Pat. No. 3,822,062. The head 11 is, in general, a closed frame-like construction of somewhat V-shaped design, preferably substantially symmetrical. The lower end of the head is formed as a throat 14 from which two side walls 15,15 are inclined and diverged upwardly and outwardly. The upper ends of the side walls 15,15 are connected by a transverse top or end wall 16 which merges with the side walls through intervening smoothly curved portions 17,17.

A transverse wall 18 extends between and joins the side walls 15,15 and cooperates with throat 14 and adjacent portions of the side walls to facilitate the connection of the head 11 and handle 12. Wall 18 has an opening 19 for receiving stop means 20 of the invention as described in detail hereafter.

The Tucker et al, U.S. Pat. No. 3,822,062 more particularly discloses an arrangement which may be embodied in the webbing 13 shown in FIG. 1 by way of example; and the Crawford et al, U.S. Pat. No. 4,034,984 discloses and claims means for attachment of the webbing on the head as shown in FIG. 1, although it is noted that the tab means **13*a*** are open to allow for quicker attachment of the webbing Since details of construction of the webbing and its attachment per se are not part of the present invention, reference to U.S. Pat. Nos. 3,822,062 and 4,034,984 is, therefore, sufficient as to disclosure of one suitable kind of webbing and attachment.

The head 11, aside from the webbing 13, is preferably formed as a unitary molding of a polymer material characterized by toughness, high impact resistance and good flexibility, as well as other desirable properties explained in the aforesaid U.S. Pat. No. 3,507,495. A presently preferred material is a nylon resin marketed under the DuPont trademark ZTEL ST 801. This polymer has outstanding impact resistance and good moldability, permitting injection molding. Unreinforced ZTEL ST 801, with a water content of 0.2%, at 73° F. using the ASTM test method D638 has a tensile strength of 7800 psi, a yield strength of 7800 psi, and an elongation at break of 40%. It has a specific gravity of 1.09 using the ASTM test method D792, and a Rockwell hardness of R112 using ASTM test method D785. Another preferred material is an injection moldable polymer material sold under the DuPont trademark HYTREL. Still another material suitable for making head 11 is the reaction product of Adiprene L315 and 4,4'-methylene-bis-(2-chloroaniline) using the formulation and manufacturing procedure as set forth in the aforesaid U.S. Pat. No. 3,507,495, the disclosure of the '495 patent being incorporated herein by reference. The above-noted materials are examples of materials suitable for constructing the head found to cooperate admirably with the handle.

The handle 12 may be formed of any suitable material including a plastic, metal, or wood. Preferred handles for use with the present invention are disclosed in U.S. Pat. Nos. 4,739,994; 4,206,918, and 4,037,841 to Lewis which are incorporated herein by reference. A preferred handle as shown in the drawing is a hollow octagonal handle having an elliptical cross-section made of plastic.

The present invention, as above-noted, is primarily related to stop means for attachment to head 11. A first embodiment of the invention, shown in FIGS. 1-5, utilizes a stop means 20 for attaching the head 11 to handle 12. The stop means 20 shown in the drawing is a snap-in stop separate from the head. As apparent from the drawing, stop means 20 fits flush with wall 18 and functions as the stop, and in the embodiment shown also attaches the handle to the head.

The stop means 20 comprises a base 22 having longitudinally extending prongs 24,24. As noted above, base 22 is shaped to fit flush with wall 18 of head 11. The prongs 24,24 include ears 26,26 constructed and arranged to engage handle 12. Prongs 24,24 are constructed such that they are flexible and extend outwardly and away from each other at a distance greater than the diameter of opening 30 of handle 12. Stop means 20 is preferably made of a plastic, although other suitable materials may be used. Further, it is understood that a different number of prongs may be utilized without departing from the scope of the invention, and the prongs need not extend into and engage the handle.

Handle 12 in the illustrated embodiment includes an opening 30 for insertion of the prongs 24,24 and slots 32,32 for connectively engaging prongs 24,24. Accordingly, to attach head 11 to handle 12, snap-in stop means 20 is seated flushly on wall 18 with prongs 24,24 extending through opening 19 of head 11 and ears 26,26 connectively engage slots 32,32 of handle 12.

Figure 4:
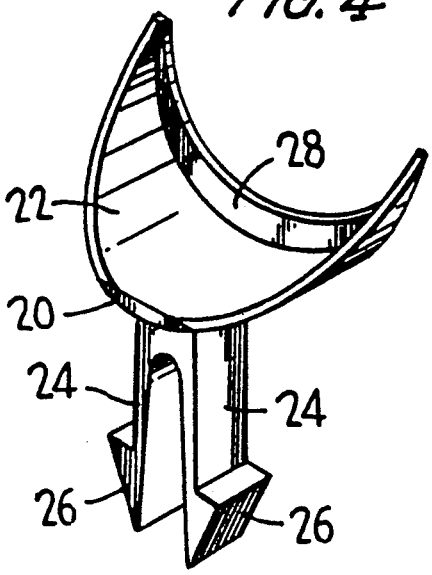
FIG. 4 is a perspective view of another embodiment of the snap-in stop means of the invention.
Figure 5:
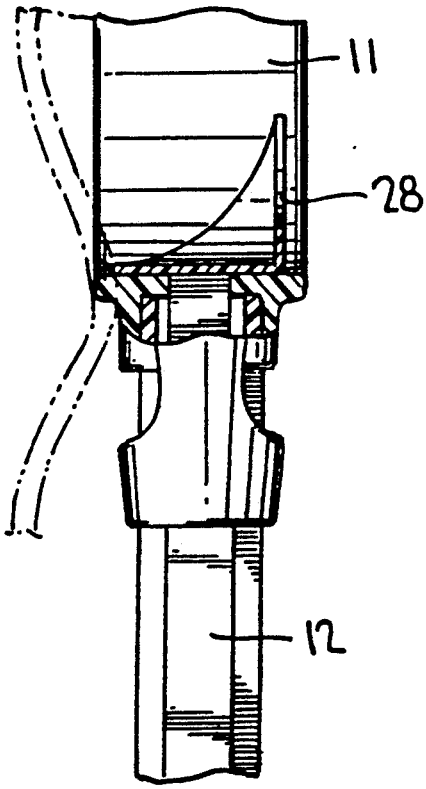
FIG. 5 is a side view, partly in section, of the lacrosse stick showing the head attached to the handle by the snap-in stop means of FIG. 4.

Referring to FIGS. 4 and 5, stop means 20 may include a lip 28 which functions to hold a lacrosse ball in place in the head 11. Lip 28 may include the trademark of the product manufacturer.

Various modifications will be recognized by those skilled in the art based on the present teaching. Thus, although only select preferred embodiments have been specifically illustrated and described herein, it is to be understood that various modifications and embodiments can be utilized to provide the lacrosse stick of the present invention without departing from the spirit of the invention and the scope of the appended claims.

It is claimed:

1. A head for a lacrosse stick comprising a generally V-shaped frame adapted to receive a web, said frame being defined by two side walls joined at a juncture and diverging therefrom, a transverse wall joining the ends of said side walls opposite of said juncture, means for securement of a web onto said frame and stop means, said juncture having an opening therein and said stop means comprising a base and at least one leg integral with and extending from said base removably fitted into said opening in said juncture with said base fitting substantially flush with said juncture.

2. The head for a lacrosse stick according to claim 1 wherein said means for securement are tab means.

3. A lacrosse stick head according to claim 2, wherein said tabs are constructed and arranged with said side walls to project inwardly thereof and being substantially flush with the top surface thereof.

* * * * *